United States Patent [19]

Poloni

[11] Patent Number: 4,641,511

[45] Date of Patent: Feb. 10, 1987

[54] STRAIGHTENING MACHINES, AND STRAIGHTENING MACHINES THUS IMPROVED

[75] Inventor: Alfredo Poloni, Ronchi dei Legionari, Italy

[73] Assignee: Danieli & C. Officine Meccaniche SpA, Buttrio, Italy

[21] Appl. No.: 667,832

[22] Filed: Nov. 2, 1984

[30] Foreign Application Priority Data

Nov. 21, 1983 [IT] Italy ..... 83505 A/83

[51] Int. Cl.[4] ..... B21D 1/02; B21D 1/14

[52] U.S. Cl. ..... 72/160; 72/239

[58] Field of Search ..... 72/160, 164, 239

[56] References Cited

U.S. PATENT DOCUMENTS

| | | | |
|---|---|---|---|
| 385,058 | 6/1888 | Jones | 72/239 |
| 2,058,717 | 10/1936 | Paterson | 72/239 |
| 2,567,537 | 9/1951 | Workman | 72/183 |
| 3,555,871 | 1/1971 | Hlafcsak | 72/239 |
| 3,559,441 | 2/1971 | Lemper et al. | 72/239 |
| 3,648,505 | 3/1972 | Eibe et al. | 72/239 |
| 3,782,161 | 1/1974 | McGeeney et al. | 72/239 |
| 4,368,633 | 1/1983 | Nogota | 72/239 |

FOREIGN PATENT DOCUMENTS

| | | | |
|---|---|---|---|
| 141629 | 5/1980 | German Democratic Rep. | 72/239 |
| 8914 | 6/1961 | Japan | 72/239 |
| 36620 | 9/1972 | Japan | 72/239 |

*Primary Examiner*—Daniel C. Crane

*Attorney, Agent, or Firm*—Wegner & Bretschneider

[57] ABSTRACT

A straightening machine for rolled, extruded or drawn products includes a frame and removable, offset upper and lower sets of rollers. The rollers are mounted on respective upper and lower supports, with the lower supports being vertically movable with respect to the upper supports, with the lower supports being vertically movable with respect to the upper supports. A carrier within the frame can be used to remove the rollers from the machine.

9 Claims, 4 Drawing Figures

STRAIGHTENING MACHINES, AND STRAIGHTENING MACHINES THUS IMPROVED

This invention concerns improvements to straightening machines. To be more exact, the invention concerns improvements to roller straightening machines employed to straighten rolled products such as bars or structural sections, or extruded or drawn products or other semi-finished products which can be likened thereto.

According to one aspect of such improvements frame means or carrier means are envisaged and are called a "carrier" in the following text.

By means of such carrier it is possible to move en bloc the set of rollers of a straightening machine. This facilitates the operations of replacing the rollers and of maintenance work.

According to another aspect of the invention the mechanical strength of the machine is increased owing to the special structure provided for the machine. Or else, given a strength equal to that of known machines, the straightening machine of the invention has a lighter structure.

The invention concerns also roller straightening machines which employ the improvements of the invention.

One embodiment of the known art envisages the replacement of the rollers of roller straightening machines by withdrawing them one by one from the straightening machine.

Before now it has been necessary to remove the cap or head which closes the frame of the straightening machine at its top in known embodiments.

Such cap is necessary for the mechanical strength of the straightening machine since it has to absorb the straightening stresses at least partially.

In this known method the upper row of rollers is withdrawn first and is followed by the lower row of rollers.

It is obvious that such a method of withdrawal entails a considerable loss of time, the rollers being withdrawn in an uncoordinated manner.

Moreover, with the structure provided for such type of straightening machine the straightening stresses are absorbed by the cap and the frame of the straightening machine itself on a closed-ring structure of great length.

So as to obviate excessive deformations caused by the heavy stresses, it is necessary to provide the straightening machine with a frame and cap of great dimensions and therefore of a great bulk and weight.

Embodiments which are intended to withdraw sets of rolls en bloc are known in the art.

No. JP-A-55-57312 discloses a rolling mill in which the whole set of rolls is installed on a support frame detachable from the base and can therefore be withdrawn.

No. CH-A-539.467 discloses rolls of a straightening unit for continuous casting which are fitted to a series of extractable supports, each of which contains two horizontal or vertical rolls.

No. DE-A-634.346 discloses a straightening machine in which the set of rolls is supported by a housing. The upper shoulder seems to be bolted to the base and to have a traditional structure.

No. DE-A-687.920 discloses a rotatable turret for straightening machines which is suitable for bearing several sets of rolls, which it interchanges by rotation.

No. DE-A-1.250.237 dwells upon means for adjusting from below the distance between centers of two sets of rolls.

No. DE-A-3.000.448 discloses a device to engage and change rolls with a vertical axis.

U.S. Pat No. 2,491,286 discloses a rolling mill with vertical rolls supported inside a releasable housing.

U.S. Pat. No. 2,634,635 (GB Pat. No. 653,469) discloses a three-high rolling mill like that described in No. JP-A-55-57312 cited above.

U.S. Pat. No. 3,733,877 teaches a slidable frame system which supports the rolls of a rolling mill and includes means to connect together the housings of the various rolls, thus enabling the weight of the upper roll to be discharged onto the slidable frame.

No. FR-A-2.320.795 discloses generically the employment of a device for rapid exchange of the rolls, the device being applied to a straightening machine.

No. FR-A-2.372.661 discloses a bridge-type device for changing the rolls of a rolling stand, with access from above.

GB Pat. No. 1,298,592 discloses a vertical rolling stand releasably fitted to a base.

No. DE-A-1.941.186 discloses the use of a carriage which can be withdrawn sideways and to which the rollers and relative supports are fitted. According to this embodiment, as soon as the whole assemblage has been unclamped from the machine, it can be withdrawn sideways en bloc.

Although this embodiment is satisfactory from the points of view of maintenance and speed of replacement, yet it entails some drawbacks.

A first drawback is the lateral bulk which is involved since it is necessary to have an appropriate sliding path for the withdrawal of the carriage in question.

According to such system it is not possible, for instance, to have two straightening machines positioned parallel and close to each other.

Moreover, the known straightening machines formed according to this embodiment too comprise an upper cap, which absorbs the straightening stresses, behaving like a deflected loaded beam having a length substantially the same as the overall length of the machine.

It is therefore necessary to have an oversized cap so as to avoid excessive deformations, and this will entail the shortcomings mentioned above as regards weight and bulk.

It is a purpose of this invention to overcome the shortcomings and drawbacks described above.

The invention provides a carrier device able to move the set of rollers of the straightening machine en bloc and to install them or withdraw them from above.

In fact, the carrier has the task of supporting the rollers momentarily during their withdrawal and displacement.

Such carrier is normally located within the frame of the straightening machine and does not come into contact with the rollers even during straightening operations.

According to this invention a quick replacement of the whole set of rollers is made possible in the following way.

A carrier according to the invention is positioned in the neighborhood of the straightening machine, with a set of rollers to be fitted already placed upon it.

The set of rollers to be replaced is withdrawn by means of a carrier already cooperating with the frame of the straightening machine and is taken away.

The carrier holding the set to be installed is lowered within the straightening machine and positions itself, disengaging the rollers, which rest on the frame of the straightening machine by means of the relative supports.

The carrier of the improvements of the invention consists essentially of a frame having, for instance, a quadrangular shape suitably reinforced and equipped with cradles able to sustain the lower rollers or their supports or both.

The supports of the rollers are conformed in such a way that, when the rollers are withdrawn, the supports of the upper rollers can cooperate with the supports of the lower rollers by resting thereon in a stable manner.

In this way, when the frame or carrier of the invention is withdrawn, not only the lower rollers but also the upper rollers are lifted with it.

Such frame or carrier comprises vertical uprights able to cooperate with the frame of the straightening machine and also includes means able to cooperate with crane means or bridge crane means, such as hook means, eyelets or the like to transport the carrier.

In a preferred embodiment the straightening machine to which the invention is applied comprises means able to sustain and position the supports of the upper rollers, which are thus stationary.

The straightening machine includes means for the vertical adjustment of the lower rollers so as to regulate the thickness or free gap between the upper and lower rollers during straightening operations.

In this embodiment, when the frame or carrier of the invention has been introduced into the machine, where it is aligned by means of suitable abutments, it is lowered until the rollers have been freed.

In fact, the carrier is usually located with its lower cradle at a level lower than the lower row of rollers, which are now disengaged and are rested on the relative means that regulate their height.

According to the invention the upper cap included in known straightening machines is eliminated and therefore a great saving of weight and overall size is obtained.

In fact, according to the structure provided for the straightening machine the stresses are discharged onto the clips which clamp the roller supports and onto the lateral portions of the frame.

There is therefore no load applied by long portions of the frame, such as the cited cap of traditional machines, nor are there the consequent problems relating to undesired bending and deformation.

Moreover, to enable the rollers to be withdrawn, the invention provides for the employment of telescopic extensions which can be disengaged from the rollers by simple retraction.

In this way, when such extensions have been retracted, for instance by suitable actuators or even by hand, it is possible to withdraw the carrier with the rollers on it after engaging the carrier with the chains of a bridge crane, for example.

The carrier is lifted within the frame of the straightening machine and engages the lower rollers first, lifting them and the relative supports; on these supports it then sustains the supports of the upper rollers.

In this way the carrier removes during its ascent both sets of rollers, the lower set and upper set respectively. It is thus possible to replace or maintain the sets of rollers very quickly.

This invention is therefore obtained with improvements to straightening machines for rolled, extruded or drawn products, the improvements cooperating at least momentarily with the frame of the straightening machine and being characterized by comprising carrier means with cradle means for momentary support of at least part of the straightening rollers, means for at least momentary positioning being included.

The invention is also embodied with a roller straightening machine which employs the above improvements.

There is described hereinafter, as a non-restrictive example, a preferred embodiment of the invention with the help of the attached figures, in which.

Figure 1:
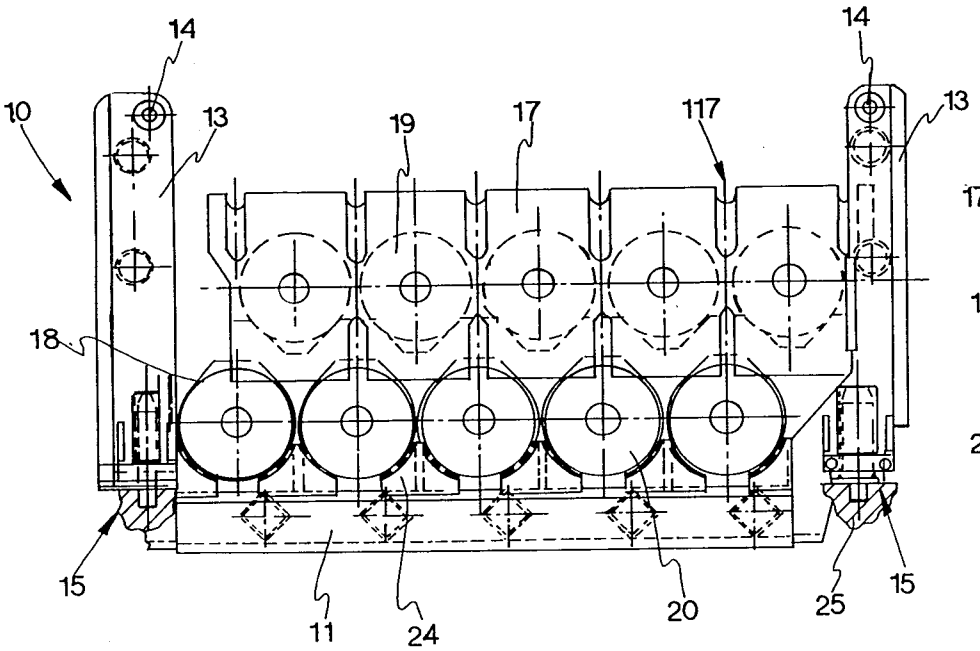

In FIG. 1 a carrier 10 according to the invention has the form of a framework provided in its lower part with two lengthwise members 11 joined together with crosspieces 12.

The assemblage of lengthwise members 11 and crosspieces 12 forms a base having a substantially rectangular shape and equipped with seatings or cradles 24 intended in this case to accommodate lower rollers 20 during movement.

However, it is possible to envisage that the cradles 24 are able to cooperate momentarily with supports 18 of the rollers 20, or possibly with the rollers 20 and with the supports 18.

The carrier 10 comprises four vertical uprights 13 at the four corners of the rectangular base. In this case the uprights 13 comprise eyelets 14 able to cooperate with hooks of chains of a bridge crane or other equivalent conveyor means for handling purposes.

The uprights 13 on each side of the carrier 10 are joined together by tubular stiffening crosspieces 16.

As can be seen in the figure, the carrier 10 is completely open on its longer sides and at its top.

Supports 17 and 18 for the upper and lower rollers respectively protrude at the sides of the carrier 10, whereas upper rollers 19 and lower rollers 20 are located within the frame itself.

The lower rollers 20 are rested at their ends on the cradles 24 when the device is employed to move the sets of the upper and lower rollers 19-20 respectively.

Abutment means 15 can be seen which can align the carrier 10 in relation to a frame 25 of the straightening machine 23. Such means 15 facilitate the positioning of the carrier 10 and correspondingly of the sets of upper and lower rollers 19-20.

Figure 2:
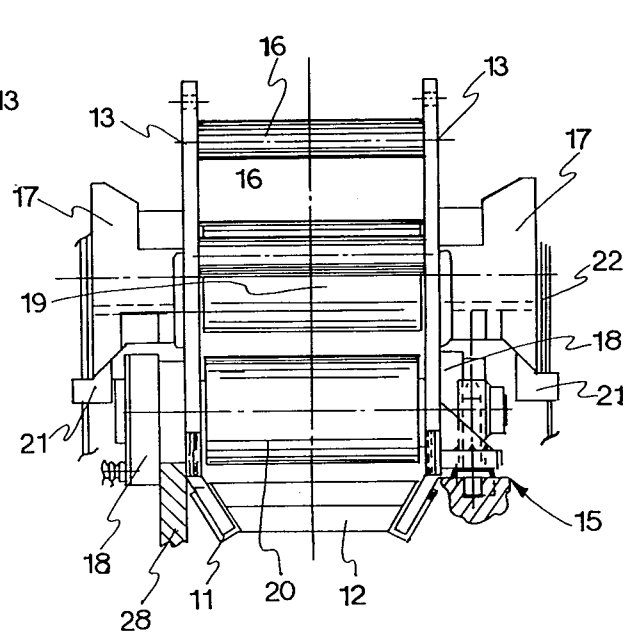
FIGS. 1 and 2 show the carrier engaging the sets of rollers.

As can be seen in particular in FIG. 2, the supports 17 of the upper rollers 19 are shaped appropriately by having in their lower portion wedge-shaped means or means with an inclined surface. Such means can cooperate with corresponding abutment and support means 21, which include an oblique surface able to sustain and position such upper supports 17 properly.

In this example the abutment and support means 21 are solidly fixed to walls 22 of the straightening machine 23.

When the carrier 10 is located within the straightening machine 23 (see also FIGS. 3 and 4), the lower cradles 24 do not touch the lower rollers 20. In fact, the cradles 24 are positioned lower than the rollers 20 since the carrier 10 rests directly on the frame 25 of the straightening machine 23, while the supports 18 of the lower rollers 20 rest on adjustment means 28 shown in FIG. 3.

When the carrier 10 is lifted for withdrawal, it engages first the lower rollers 20 with its cradles 24. In this way the lower row of rollers 20 is lifted first.

During this ascent movement the supports 18 engage the supports 17 of the upper rollers 19. The lower 18 and upper 17 supports are conformed in a complementary manner, as can be seen in particular in FIGS. 1 and 4.

Thus the set of upper rollers 19 is lifted and positioned by the lower set and in this way, as the vertical travel of the carrier 10 proceeds, both rows of rollers 19-20 are lifted for withdrawal.

Figure 3:
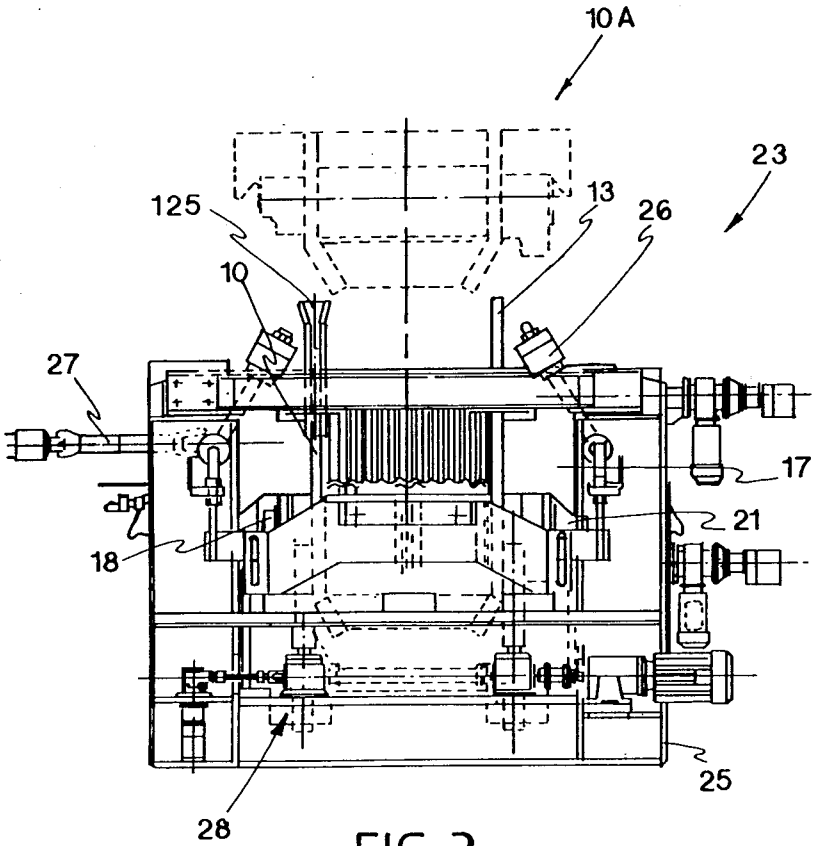
FIG. 3 is a partially cutaway view of an improved straightening machine of the invention in the direction of feed of the products to be straightened.

FIG. 3 shows a raised position 10A of the carrier 10; engaged rollers and relative supports can be seen.

FIG. 3 also shows the supports 17 of the upper rollers 19 rested on the abutment and support means 21 solidly fixed to the frame 25 of the straightening machine 23. In this example such frame 25 comprises guide means 125 cooperating with the uprights 13 to facilitate introduction of the carrier 10 into the straightening machine 23.

FIG. 3 also shows telescopic extensions 27 which can be retracted by known means, thus freeing the upper set of rollers 19.

Reciprocal engagement of such extensions 27 with the rollers 19 is obtained by means of rapid couplings, for instance of a male/female type, or by means of notches or another known equivalent type.

Figure 4:
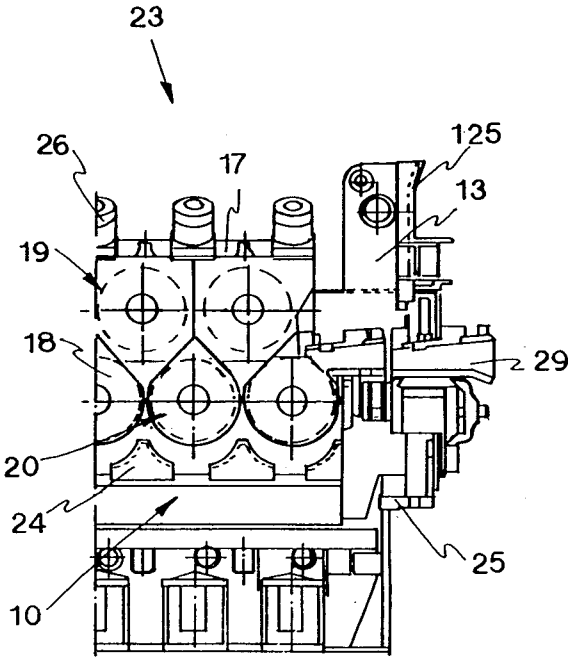
FIG. 4 is a partial cutaway view of the straightening machine of FIG. 3 in a direction axial to the rollers.

FIG. 4 shows also means 29 for entry of rolled products; such means 29 serve, as is known, to guide rolled products for their entry between the rollers 19-20.

Clamp means 26 can be seen in the upper part of the straightening machine 23 and consist in this example of hydraulic clips which can be rotated to free the supports 17 of the upper rollers 19. Such clips 26 press into appropriate channels 117 located between neighboring supports 17.

Such hydraulic clips 26 are rotatably fitted to the frame 25 and can be slackened by being turned to an outer position, thus freeing the set of upper rollers 19.

When the machine 23 is in its working position, the supports 17 are therefore clamped between the hydraulic clips 26 and the abutment and support means 21, and the upper rollers 19 are clamped in this way.

Instead, the lower rollers 20 are free in an upwards direction, being sustained by the adjustment means 28. Such means 28 can be of any required type; in the example shown they are of a mechanical jack type and are driven by an electric motor.

The structure provided for the straightening machine 23 according to the improvements of this invention arranges that the straightening stresses are discharged on each side of the machine 23 according to a closed ring. Such ring comprises the support 17 of the upper roller 19, the clip 26, a part of the frame 25, the adjustment means 28 and the support 18 of the lower roller 20.

It should be noted that the part of the frame 25 onto which the straightening stress is discharged is the lateral part. It is therefore unnecessary, as stated earlier, to employ a cap on top of the frame 25.

There has been described here a preferred embodiment of this invention but many variants are possible without departing thereby from the scope of the invention.

For instance, the carrier 10 can have dimensions and proportions other than those shown and/or with a different structure, such as a trellis or other structure, for example.

Likewise, the cooperation between the carrier 10 and frame 25 of the straightening machine 23 can be arranged in a manner other than that shown; the supports 17-18 of the rollers 19-20 can also be conformed differently from the conformations described and shown.

The clamp means 26 can be of another type, as also can the cooperation between such means 26 and the supports 17 of the upper rollers 19.

I claim:

1. A straightening machine for rolled, extruded, or drawn products, comprising:

a frame;

upper straightening rollers and lower straightening rollers mounted in said frame, said upper straightening rollers being offset relative to said lower straightening rollers;

carrier means mounted within said frame comprising engagement means for engaging a lifting device to vertically withdraw said carrier means from the frame, and cradle means capable of at least momentary support of at least a part of said straightening rollers;

upper and lower supports for said upper and lower straightening rollers, said upper support containing a plurality of said upper straightening rollers and said lower support containing a plurality of said lower straightening rollers, said lower supports being vertically movable with respect to said upper supports, said upper and lower supports having cooperating faces which engage each other at least momentarily during withdrawal of said carrier means from the frame; and means on said frame and carrier for at least momentarily positioning said carrier means on said frame by engagement of said carrier means with said frame.

2. A straightening machine as claimed in claim 1, wherein the frame has an open top.

3. A straightening machine as claimed in claim 1, wherein said cradle means contacts at least a part of the supports at least momentarily during withdrawal of the carrier means.

4. A straightening machine as claimed in claim 1, further comprising clamping means on said frame to clamp said supports.

5. The straightening machine of claim 1, wherein said carrier means cooperates with at least part of said frame.

6. The straightening machine of claim 1, wherein said cradle means is in contact with at least part of said straightening rollers at least momentarily during withdrawal of said carrier means.

7. The straightening machine of claim 5, wherein said carrier means cooperates with at least part of said straightening rollers at least momentarily during withdrawal of said carrier means.

8. The straightening machine of claim 1, further comprising abutment and support means and wherein said supports for said upper straightening rollers normally cooperate therewith.

9. The straightening machine of claim 1, further comprising guide means for the facilitated introduction of said carrier means.

* * * * *